United States Patent [19]

Smith

[11] 4,305,215

[45] Dec. 15, 1981

[54] IDENTIFICATION BADGE HOLDER

[76] Inventor: Samuel C. Smith, 210 Hartman Rd., Newton Centre, Mass. 02159

[21] Appl. No.: 127,831

[22] Filed: Mar. 6, 1980

[51] Int. Cl.[3] ..... A44C 3/00

[52] U.S. Cl. ..... 40/1.5

[58] Field of Search ..... 40/1.5, 1.6, 11 R, 23 R, 40/10

[56] References Cited

U.S. PATENT DOCUMENTS

| | | | |
|---|---|---|---|
| 2,609,629 | 9/1952 | Hubbard | 40/1.5 |
| 2,618,086 | 11/1952 | Kmomrous | 40/1.5 |
| 2,914,896 | 12/1959 | Allen | 40/1.5 |
| 2,929,161 | 3/1960 | Kuyk | 40/11 R |
| 3,500,568 | 3/1970 | Hushek | 40/1.5 |

*Primary Examiner*—Gene Mancene
*Assistant Examiner*—Wenceslao J. Contreras
*Attorney, Agent, or Firm*—Maurice R. Boiteau

[57] ABSTRACT

There is disclosed in the present application an identification badge holder made of a single piece of transparent plastic sheet folded so as to enclose and protect one or two cards which are visible from both sides of the holder. The present holder includes an integral flap having a sawtooth shaped edge and inwardly bent corners to retain the badge on a wearer's clothing and is sufficiently thin, flexible and compact to be carried in owner's wallet.

3 Claims, 4 Drawing Figures

IDENTIFICATION BADGE HOLDER

The present invention relates generally to improvements in identification badges and to holders for such badges and more particularly to such badges and holders which are intended both to be worn on the person and to be carried in a wallet when not in use for identification purposes.

The practice of either requiring the wearing of badges at various functions or the need to wear identification for security purposes at locations where access to a facility must be controlled has led to a demand for badges which may readily be attached to clothing during attendance at the function or presence in the controlled facility. There are frequent occasions when two different forms of identification are either necessary or desirable. Such occasions are presented for example, at conventions or club meetings where, in addition to a membership card, it is also appropriate to wear a name tag to facilitate introductions. Another situation is the requirement for different badges for installations requiring different degrees of clearance for access to different areas of the facility. Under both such circumstances the ready availability of two badges or forms of identification worn simultaneously on the person is very advantageous.

Another problem connected with the wearing of badges concerns the disposition of the badge when it is not required to be worn. It is then desirable that the badge and/or holder be easily storable in the owner's wallet until needed at a later time.

It is accordingly an object of the present invention to provide a badge and/or holder which may be economically manufactured in large quantities.

Another object is to provide a badge which may be easily stored in an owner's wallet, offer protection and yet not cause discomfort to the owner.

Still another object is to provide a badge and/or holder which does not require assembly in going from a stored condition in the owner's wallet to a displayed condition on the person.

In the achievement of the foregoing objects, a feature of the present invention relates to a badge holder which is formed entirely of a single sheet of transparent plastic material. According to a related feature, the plastic sheet is folded to provide an integral flap having a sawtooth pattern along its edges to anchor the badge holder to the wearer's clothing while permitting both sides of the holder to be visible through the plastic material to allow two separate forms of identification to be alternately displayed in the same holder.

In addition to the sawtooth edges, the corners of the anchor flap are bent inwardly. This has a two-fold purpose. Firstly, it provides gripping action at the extreme points of the flap; secondly, it facilitates handling when inserting in pocket by virtue of the available space for finger lifting of the flap.

The foregoing objects, features and numerous advantages flowing from the present invention will be clarified from the following detailed description of an illustrative embodiment taken in connection with the accompanying drawings.

DETAILED DESCRIPTION OF THE DRAWINGS

Figure 1:
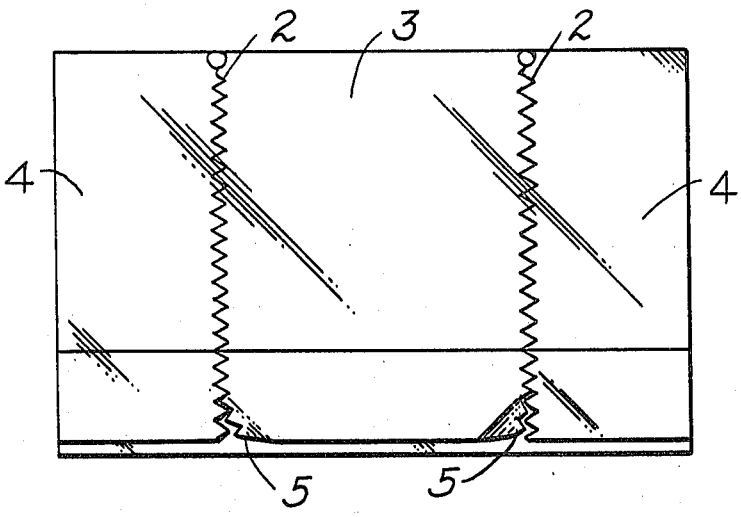
FIG. 1 is a rear view of a badge holder according to the present invention.

Referring now to the drawings in detail, a single piece of transparent plastic sheet 1 with zigzag incisions 2 separating a center flap 3 from two outside panels 4 and having the corners 5 of the flap 3 bent inwardly. FIG. 1 illustrates the rear view of the badge holder device incised and folded as already described. While the folded dimensions of the badge holder may be of any convenient size, the preferred overall dimensions are $2\frac{1}{8}''$ wide by $3\frac{1}{2}''$ long. The flap 3 being overall $1\frac{7}{8}''$ long and the remaining length being divided between the two panels 4. The preferred thickness of the plastic sheet is 1/64 ".

Figure 2:
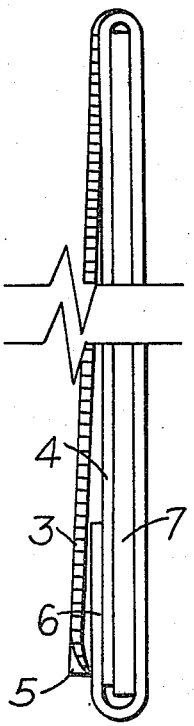
FIG. 2 is an end view (part broken away) on an enlarged scale of the holder of FIG. 1.

FIG. 2 is a side view (part broken away) on an enlarged scale, of the badge holder 1 enclosing a badge card 7, an inwardly bent corner 5 of the flap 3 and the position of the panels 4 inside of a lip 6. In the position shown, the badge card 7 is securely retained and the flap 3 is ready to be applied to an article of clothing such as a pocket where the zigzag edges 2 together with the bent corners 5 of the flap securely anchor the badge.

Figure 3:
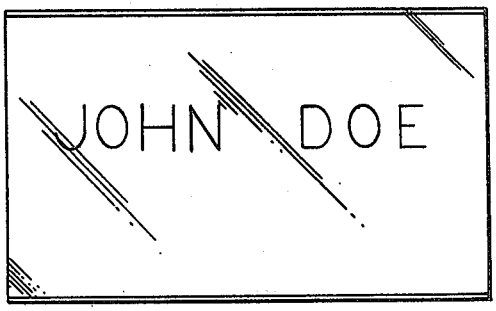
FIG. 3 is a front view of the holder of FIG. 1 with an identification card showing.
Figure 4:
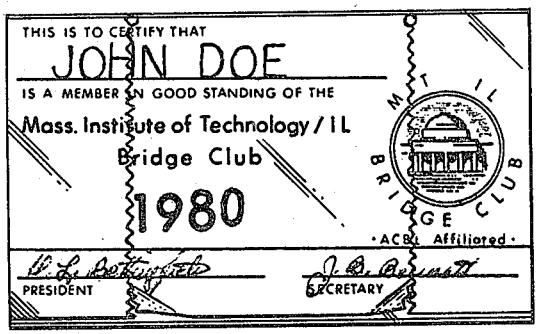
FIG. 4 is a rear view of the holder of the previous Figures but with a membership card showing.

FIGS. 3 and 4 illustrate the dual purpose of the badge device. Here, the combined membership-identification card is securely in place and remains there until expired at which time it is removed and a new one inserted in its place.

Having thus disclosed my invention, what I claim as new and desire to secure by Letters Patent of the United States is:

1. A badge holder consisting of a single sheet of transparent material formed with a first fold to provide an integral lip to retain an identification card in the holder and a second fold dividing the remainder of the sheet into a first panel extending between the lip and the second fold and a second panel extending from the second fold to a free edge of the second panel and generally coextensive with the first panel and a retaining flap defined by a pair of spaced apart incisions extending from the free edge across substantially the entire width of the second panel to the second fold.

2. A badge holder according to claim 1 further characterized in that the flap is defined by zigzag edges for retaining the holder on an article of clothing.

3. A badge holder according to claim 1 further characterized in that the two corners of the flap are bent inwardly thereby providing additional grip to anchor the holder on an article of clothing and finger access for handling the flap when positioning on an article of clothing.

* * * * *